US007900495B2

(12) United States Patent
Latoria

(10) Patent No.: US 7,900,495 B2
(45) Date of Patent: Mar. 8, 2011

(54) POWERED CONDUIT BENDER

(75) Inventor: Joseph S. Latoria, West Chicago, IL (US)

(73) Assignee: Huskie Tools, Inc., Glendale Heights, IL (US)

( * ) Notice: Subject to any disclaimer, the term of this patent is extended or adjusted under 35 U.S.C. 154(b) by 59 days.

(21) Appl. No.: 12/459,650

(22) Filed: Jul. 6, 2009

(65) Prior Publication Data

US 2011/0000273 A1 Jan. 6, 2011

(51) Int. Cl.
*B21D 7/04* (2006.01)

(52) U.S. Cl. ..... 72/458; 72/31.01; 72/31.04; 72/37; 72/157; 72/319; 72/383; 72/459

(58) Field of Classification Search ..... 72/31.01, 72/31.04, 37, 149, 157, 217, 319, 320, 383, 72/384, 458, 459
See application file for complete search history.

(56) References Cited

U.S. PATENT DOCUMENTS 3,785,190 A * 1/1974 Schall et al. ..... 72/149
4,196,610 A 4/1980 Chilton
4,452,064 A 6/1984 Custin
4,843,858 A * 7/1989 Grimm et al. ..... 72/149
4,887,992 A 12/1989 Dixon
5,927,141 A 7/1999 Walsten
6,769,282 B2 * 8/2004 Henden ..... 72/383
6,820,457 B2 11/2004 Luebke et al.
7,055,362 B2 * 6/2006 Widmayer ..... 72/458

OTHER PUBLICATIONS

Greenlee Catalog, pp. 101-118, 2007.

* cited by examiner

*Primary Examiner* — David B Jones
(74) *Attorney, Agent, or Firm* — Wood, Phillips, Katz, Clark & Mortimer

(57) ABSTRACT

A powered conduit bending tool comprises a portable drive housing including a handle and having a powered drive gear. A bracket is secured to the housing defining a pivot connection spaced from the drive gear. A guide is operatively secured to the housing. A platform is pivotally connected to the bracket at the pivot connection and includes a driven gear operatively engaging the drive gear to controllably pivot the platform. A shoe is removably mountable to the platform and comprises a first bender defining a downwardly opening arcuate channel selectively positionable proximate the guide. A hook is proximate one end of the bender for engaging a conduit received in the channel. In use, the guide supports a conduit engaged by the hook and pivotal movement of the shoe driven by the platform deforms the conduit as it passes by the guide.

19 Claims, 6 Drawing Sheets

POWERED CONDUIT BENDER

CROSS REFERENCE TO RELATED APPLICATIONS

There are no related applications.

BACKGROUND OF THE INVENTION

1. Field of the Invention

This invention relates to a conduit bender and more particularly, to a powered conduit bender.

2. Background Art

Tubing, such as electrical conduit, is conventionally supplied as a straight, elongate tube. Prior to installation, it is often necessary to provide a bend in the conduit. This is often accomplished with a manually operated tool known as a conduit bender which provides a desired bend in the conduit without collapsing of the conduit walls.

A typical conduit bender includes a handle and a head. The head is of one piece construction including an arcuate shoe with a laterally concave groove for supporting the conduit. A hook is proximate one end of the shoe for engaging a conduit received in the channel. The handle is secured to the head and is generally positioned in a radial line relative to the arcuate shoe. The conduit rests on a support surface with the hook engaging the conduit. The handle is forced downwardly to roll the shoe onto the conduit with the hook pulling the conduit upwardly to form a bend.

Such a conduit bender requires the presence of a support surface for the conduit and the strength to force the handle to produce the bend. Also, it is necessary for the person using the conduit bender to frequently start and stop the bending operation to observe the bender relative to the conduit to see if the appropriate bending angle has been achieved.

Pending application Ser. No. 12/011,849, filed Jan. 30, 2008, and assigned to the Assignee of the present application, describes a powered conduit bender adapted to bend a single size conduit using a hand held, battery-powered tool. If required to bend different sizes of conduit, then the design disclosed therein requires a different tool for each size conduit.

The present invention is directed to further facilitating the operation of bending a conduit or similar tube.

SUMMARY OF THE INVENTION

In accordance with the invention, there is provided a portable, modular powered conduit bending tool which can be used with one handed operation.

In accordance with a first aspect of the invention, there is disclosed a powered conduit bending tool comprising a portable drive housing including a handle and having a powered drive gear. A bracket is secured to the housing defining a pivot connection spaced from the drive gear. A guide is operatively secured to the housing. A platform is pivotally connected to the bracket at the pivot connection and includes a driven gear operatively engaging the drive gear to controllably pivot the platform. A shoe is removably mountable to the platform and comprises a first bender defining a downwardly opening arcuate channel selectively positionable proximate the guide. A hook is proximate one end of the bender for engaging a conduit received in the channel. In use, the guide supports a conduit engaged by the hook and pivotal movement of the shoe driven by the platform deforms the conduit as it passes by the guide.

It is a feature of the invention that the driven gear comprises gear teeth disposed in a path adjacent the arcuate channel.

It is another feature of the invention that the driven gear comprises an arcuate rack secured to the platform.

It is a further feature of the invention that the platform comprises a pivot opening receiving a bolt connected to the bracket at the pivot connection and a guide pin is spaced from the pivot opening a select distance.

In one embodiment of the invention the shoe comprises a pipe threadably connected to the first bender and the pipe includes a pair of spaced apart openings spaced apart the select amount. One of the openings receives the bolt and the other opening receives the guide pin. The shoe may comprise a handle at a distal end of the pipe.

In another embodiment of the invention, the shoe comprises a pipe threadably connected at one end to the first bender and at a second end to a second bender of a different size from the first bender. The pipe includes a center opening, a first opening associated with the first bender and spaced from the center opening by the select amount, and a second opening associated with the second bender and spaced from the center opening by the select amount. The center opening receives the bolt and one of the first and second openings receives the guide pin dependent on which of the first and second benders is to be used.

It is still another feature of the invention that the guide comprises a spool. The spool may comprise a self-centering spool. The spool may be mounted to a shaft on the bracket with a seat spring self-centering the spool.

It is still a further feature of the invention that a battery is removably connected to the handle to provide a battery operated tool.

There is disclosed in accordance with another aspect of the invention a powered conduit bending tool comprising a portable drive housing including a handle and having a powered drive gear. A bracket is secured to the housing defining a pivot connection spaced from the drive gear. The bracket includes a shaft supporting a self-centering guide spool. A platform is pivotably connected to the bracket at the pivot connection and includes a driven gear operatively engaging the drive gear to controllably pivot the platform. A shoe is mounted to the platform and comprises a bender defining a downwardly opening arcuate channel selectively positionable proximate the guide. A hook is proximate one end of the bender for engaging a conduit received in the channel. In use, the guide spool is self-centered on the shaft to support conduit that is engaged by the hook and pivotal movement of the shoe driven by the platform deforms the conduit as it passes by the guide spool.

It is a feature of the invention that the driven gear comprises gear teeth disposed in a path adjacent the shoe.

It is another feature of the invention that the driven gear comprises an arcuate rack.

It is a further feature of the invention to provide a seat spring on the shaft between the bracket and the guide spool.

It is yet another feature of the invention that the guide spool comprises a roller.

It is an additional feature of the invention that a battery is removably connected to the handle to provide a battery operated tool.

It is still a further feature of the invention that the platform comprises a pivot opening receiving a bolt connected to the bracket at the pivot connection and a guide pin is spaced from the pivot opening a select distance.

It is still a further feature of the invention that the shoe comprises a pipe threadably connected to the bender and the pipe includes a pair of openings spaced apart the select amount. One of the openings receives the bolt and the other opening receives the guide pin.

Further features and advantages of the invention will be readily apparent from the specification and from the drawings.

DETAILED DESCRIPTION OF THE PREFERRED EMBODIMENT

Figure 1:
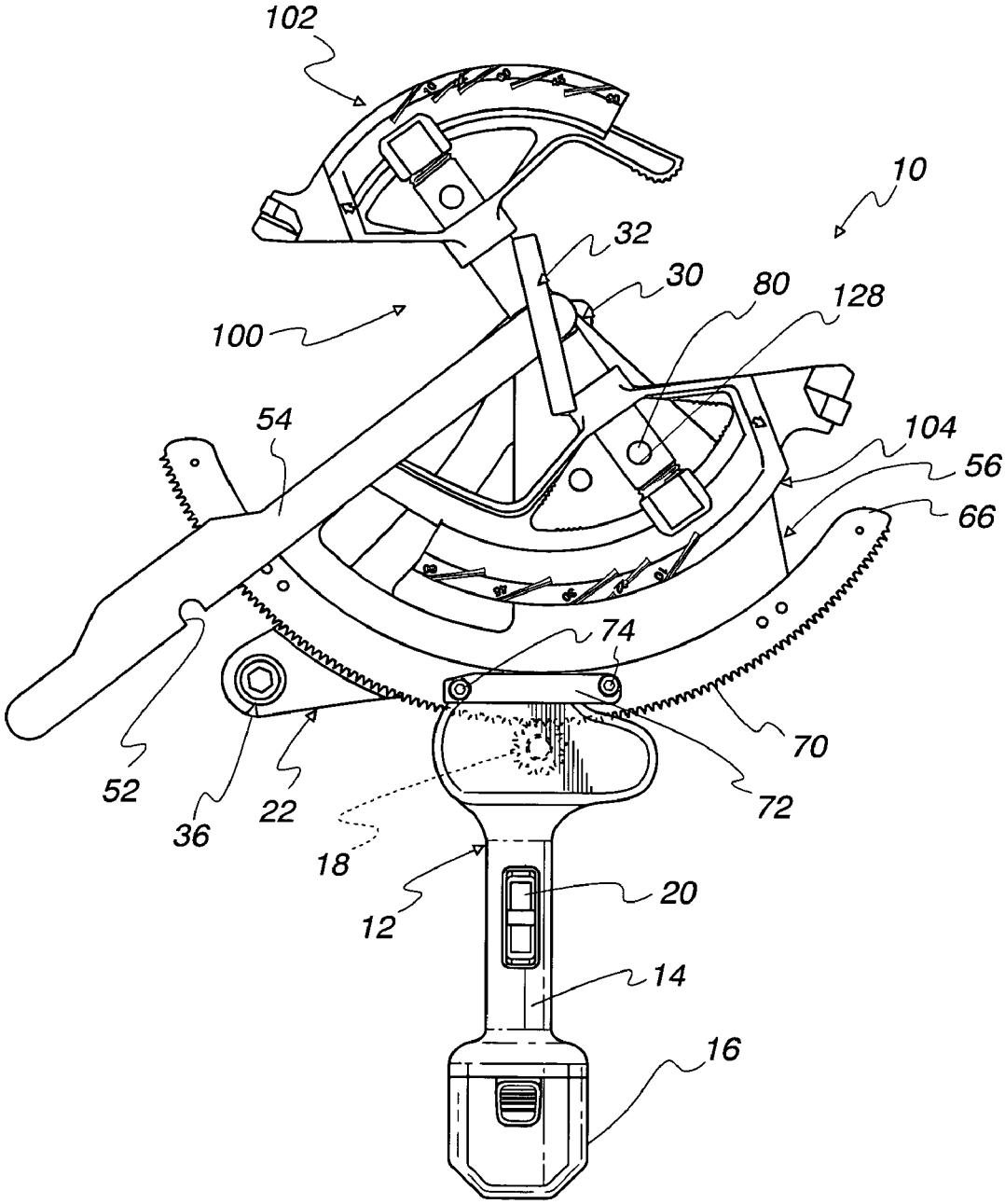
FIG. 1 is a front elevation view of a powered conduit bender in accordance with the invention including a dual bender shoe.

Referring to FIG. 1, a powered conduit bending tool 10 in accordance with the invention is illustrated. The powered conduit bending tool 10 comprises a battery powered device which enables a user using only one hand to accurately and simply bend a conduit to a desired angle. Moreover, the powered conduit bending tool 10 is part of a modular system adaptable to bend different sizes and types of conduit by enabling easy replacement of shoe sizes and automatic guide adjustment.

The powered conduit bending tool 10 includes a housing 12 including a gripping handle 14. The housing 12 is generally similar to a conventional portable tool, such as a drill. A battery 16 is removably mounted to the housing 12, in a conventional manner, and powers a battery operated powered drive having a drive gear 18 (shown in phantom). The drive in the housing 12 converts electrical power to drive the drive gear 18 in a conventional manner using a switch 20. For example, the drive may be generally similar to a conventional cordless drill, except that a chuck is replaced with the drive gear 18. Alternatively, the drive could be operated off of a 120 Vac supply and include a power cord, as will be apparent. The switch 20 is movable between a center off position and up and down positions for forward and reverse rotational movement of the drive gear 18, as described below.

The basic operation of the powered conduit bending tool 10 may be as described in pending application Ser. No. 12/011,849, filed Jan. 30, 2008, and assigned to the Assignee of the present application, the specification of which is incorporated by reference herein.

Figure 2:
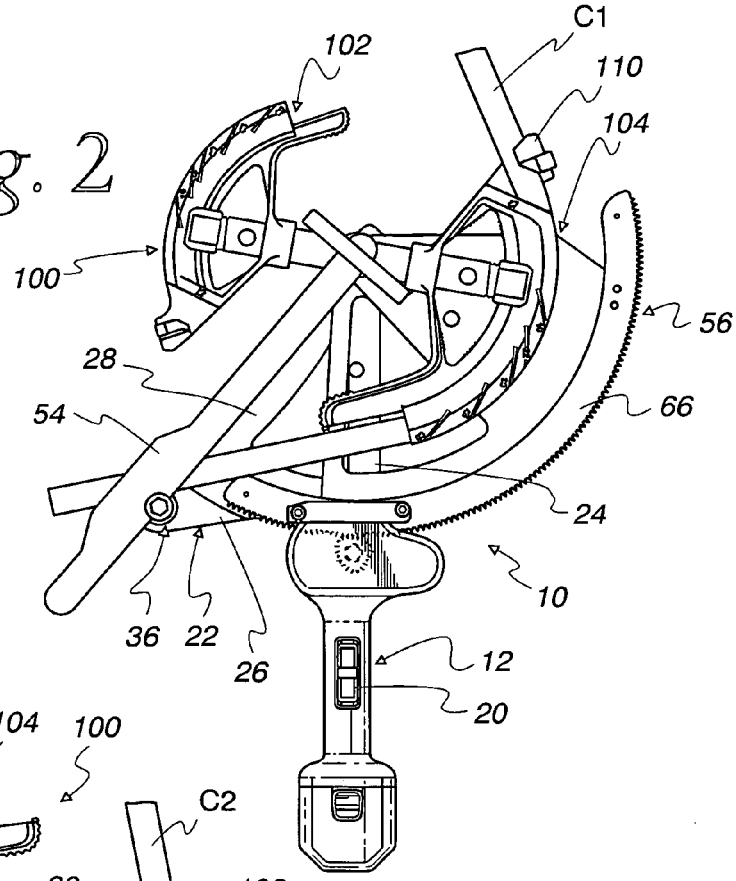
FIG. 2 is a front elevation view, similar to FIG. 1, showing the powered conduit bender configured to bend conduit of a first size.
Figure 4:
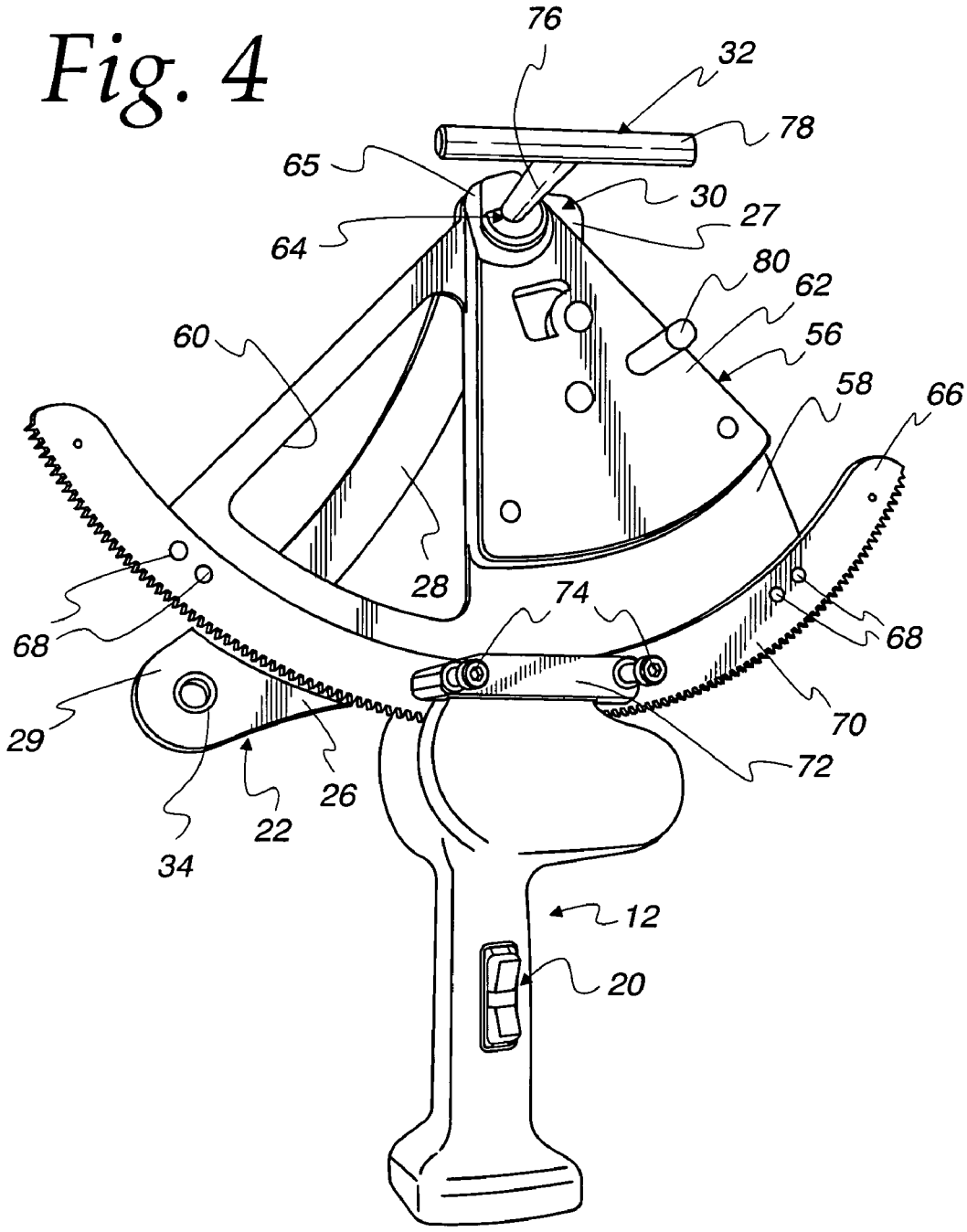
FIG. 4 is a perspective view of the powered conduit bender in accordance with the invention with the shoe removed.

Referring also to FIGS. 2 and 4, a generally triangular bracket 22 is secured to the housing 12. The bracket 22 includes a generally vertical leg 24, see FIG. 2, extending upwardly from the housing 12 and connected to a generally horizontal leg 26. Opposite ends of the vertical leg 24 and the horizontal leg 26 are connected to a generally diagonal leg 28 to provide the generally triangular configuration. The vertical leg 24 and the diagonal leg 28 meet at a top corner 27 which includes a threaded opening (not shown) to define a pivot connection 30 threadably receiving a T-shaped bolt 32, as is apparent. The pivot connection 30 is spaced from the drive gear 18. The horizontal bar 26 and the diagonal bar 28 meet at a side corner 29 which includes an opening 34, see FIG. 4, for receiving a conduit guide 36, see FIG. 1.

Figure 8:
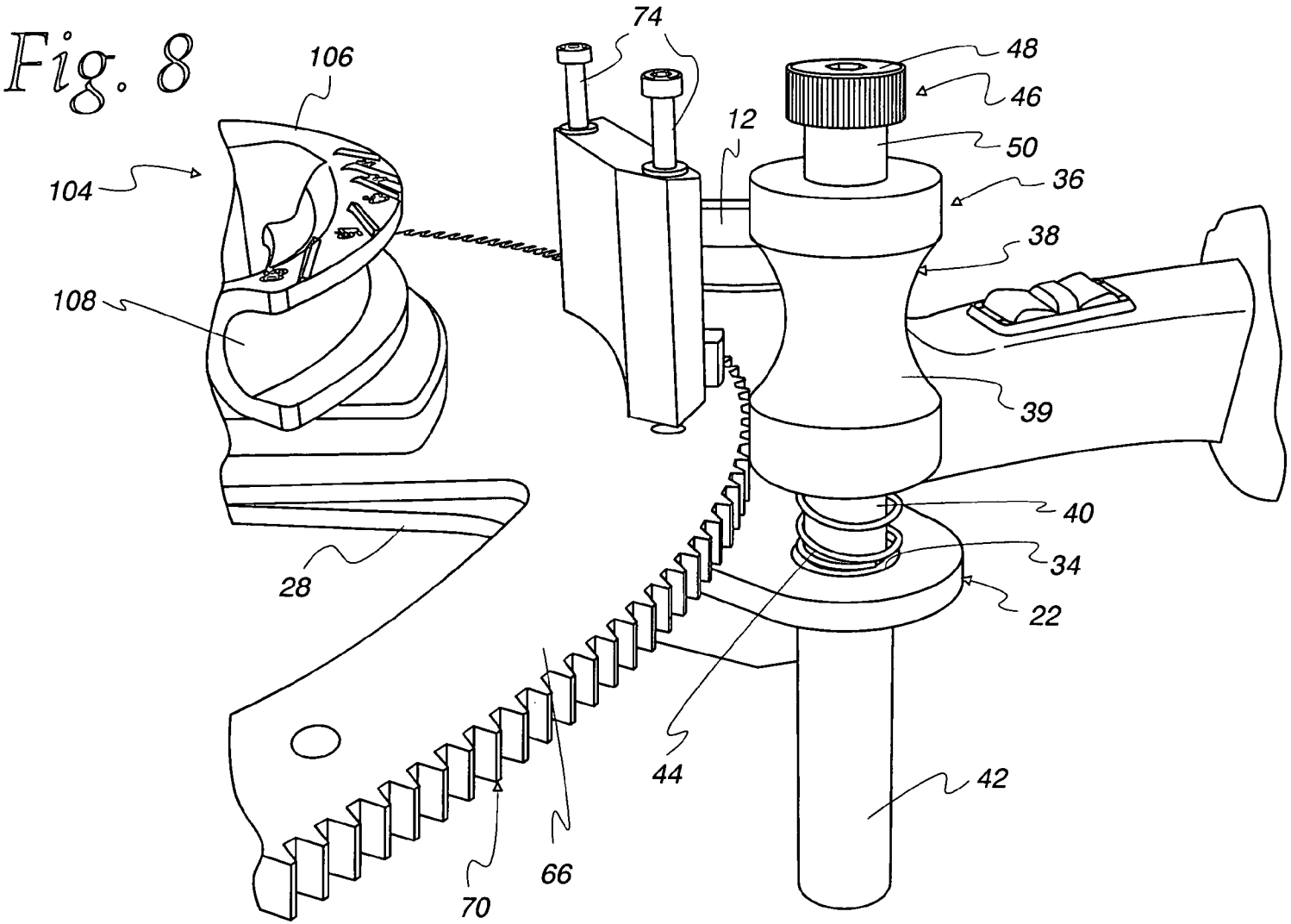
FIG. 8 is a partial, perspective view, illustrating a self-centering guide spool of the powered conduit bender of FIG. 1.

Referring to FIG. 8, the conduit guide 36 comprises a roller in the form of a guide spool 38 received on a shaft 40. The guide spool 38 includes a concave guide surface 39 for engaging a conduit. A first end 42 of the shaft 40 is enlarged and is positioned on a back side of the bracket 22 so the central part of the shaft 40 extends through the opening 34 and receives the guide spool 38. A seat spring 44 on the shaft 40 is between the guide spool 38 and the bracket 22. A nut 46 is threaded to an opposite end of the shaft 40 to retain the guide spool 38 on the shaft 40. The nut 46 includes an enlarged head 48 and a narrowed neck 50. The neck 50 receives a notch 52 in a mounting bracket 54, see FIG. 1, pivotally connected to the T-bolt 32. The notch 52 allows the mounting bracket 54 to be moved out of position, as shown in FIG. 1, when necessary. Otherwise, the mounting bracket 54 is shown captured in FIG. 2. The mounting bracket 54 distributes pressure away from the pivot connection 30.

Referring to FIG. 4, a platform 56 is pivotally connected to the bracket 22 at the pivot connection 30. The platform 56 comprises a generally triangular or pie shaped metal plate 58 having a generally triangular opening 60 at one side. At another side is a generally triangular support 62 which may be formed of aluminum or the like and is secured to the plate 58. An opening 64 passes through the support 62 at a corner 65 of the plate 58. The opening 64 is coaxial with the pivot connection 30 for receiving the T-bolt 32 to pivotally connect the platform 56 to the bracket 22. An arcuate rack 66 is secured to the plate 58 in a radius about the opening 64 using fasteners 68. The arcuate rack 66 includes a toothed outer edge 70 to define a driven gear which engages the drive gear 18, see FIG. 1. As is apparent, rotation of the drive gear 18 drives the driven gear 70 to pivot the platform 56 about the pivot connection 30.

A stabilizing bracket 72 is mounted atop the housing 12 and includes a pair of threaded bolts 74 which can be selectively positioned to bear on the arcuate rack 66, see FIG. 8, to stabilize the platform 56.

The T-bolt 32 comprises a shaft 76 and a cross bar 78. A distal end (not shown) of the shaft 76 is threaded to be selectively threadably secured to the bracket 22, as is apparent. A guide pin 80 extends upwardly from the platform 56 proximate one edge of the support 62 and spaced a select amount from the T-bolt shaft 76, as is apparent.

In accordance with the invention, the powered conduit bending tool 10 is adapted to removably mount one of different available shoes to allow the conduit bending tool 10 to be used to bend different size conduits by simply replacing the shoe. Moreover, the guide 36 is self-centering, as described below, to accommodate different size conduit.

Figure 5:
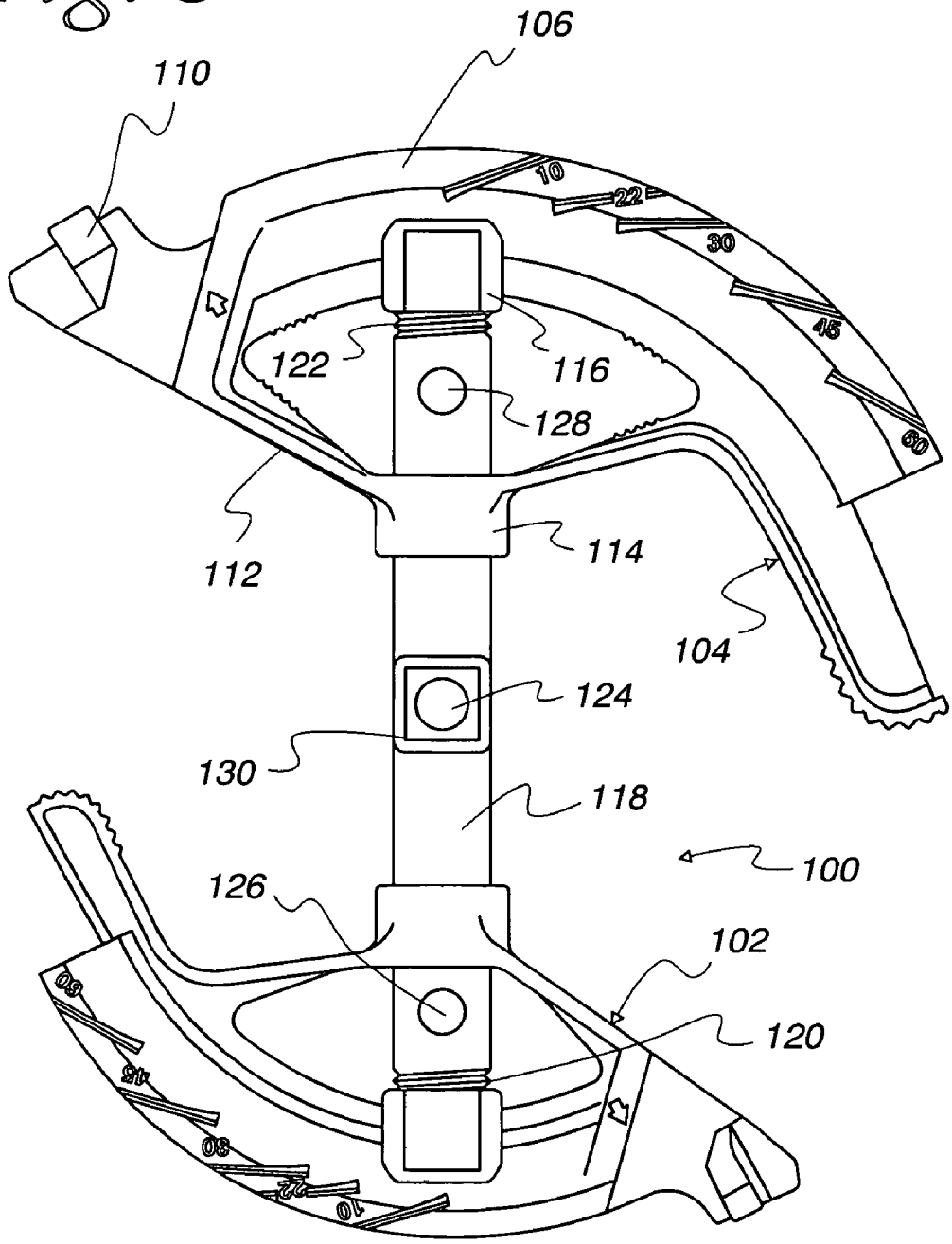
FIG. 5 is a front elevation view of the dual bender shoe of FIG. 1.
Figure 6:
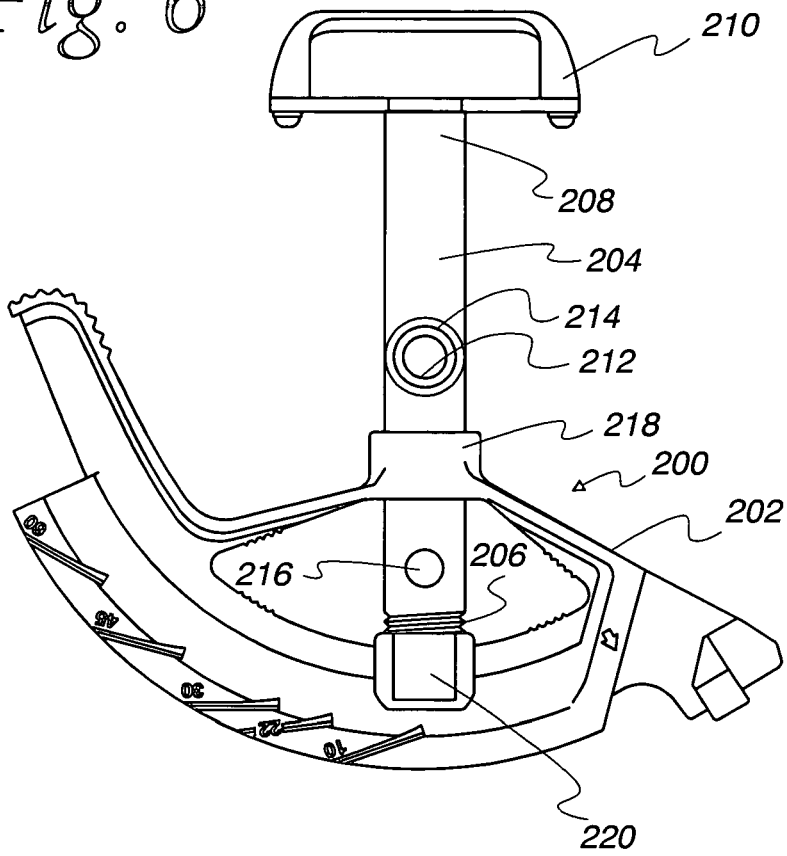
FIG. 6 is a front elevation view of a single bender shoe for a third size conduit.

In an illustrative embodiment of the invention, the powered conduit bender can be used with a dual bender shoe 100, see FIG. 5, including a first bender 102 for bending ½" EMT conduit and a second bender 104 for bending ¾" EMT or ½" rigid conduit. A first single bender shoe 200, see FIG. 6, is adapted for bending 1" EMT or ¾" rigid conduit using a bender 202. Finally, a second single bender shoe 300, see FIG. 7, includes a bender 302 for bending 1¼" EMT and 1" rigid conduit. Each of the benders 102, 104, 202, and 302 are of conventional construction and comprise commercially available manually operated conduit benders that normally mount to a pipe to manually bend conduit, as is well known. Only the second bender 104 is described in detail herein, the others being of similar construction, albeit of different size. Other examples of conduit benders are shown in U.S. Pat. Nos. 4,452,064 and 5,927,141.

The second bender 104, see FIG. 8, includes an arcuate body 106 defining a radially downwardly opening arcuate channel 108 of a cross section to receive a conduit. The channel 108 is concave and the body 106 defines a convex arc, as is known. A hook 110 is provided at one end of the arcuate body 106, see FIG. 5. A leg 112 connects opposite ends of the arcuate body 106 and includes a central collar 114 having a through opening (not shown). A female threaded adapter 116 is provided in the arcuate body 106 axially aligned with the collar 114. In a conventional, manual operation, a pipe is passed through the collar 114 and threaded into the adapter 116 in use. In accordance with the invention, a smaller pipe 118 is used having opposite first and second threaded ends 120 and 122, respectively. A center through opening 124 is provided through the pipe 118 approximately midway between the threaded ends 120 and 122. A first opening 126, associated with the first bender 102, is provided between the center opening 124 and the first threaded end 120. A second opening 128 is provided between the center opening 124 and the second threaded end 122. Spacing between the center opening 124 and each of the first opening 126 and second opening 128 is equivalent to the select spacing between the T-bar shaft 76 and guide pin 80, see FIG. 4, discussed above.

In order to mount the shoe 100 to the tool 10, the T-bolt 32 is removed by turning the crossbar 78 to unthread the connection. Thereafter, the shoe 100 is placed atop the platform 56. In a first configuration, as shown in FIGS. 1 and 2, to use the second bender 104, the shoe 100 is placed on the platform 56 so that the guide pin 80 passes through the second opening 128. Thereafter, the T-bar shaft 76, shown in FIG. 4, is inserted through the center opening 124 and threaded into the pivot connection 30 and tightened to secure the first shoe 100 to the rotary platform 56. The pipe 118 also includes a hub 130 surrounding the center opening 124 to provide suitable positioning for receiving the T-bolt 32. As is apparent, the support 62 provides a flat surface for seating the shoe 100 on the platform 56. The mounting bracket 54 can then be also placed in position, as shown in FIG. 2. In this configuration, the powered conduit bending tool 10 is used to bend a conduit C1, see FIG. 2, in the form of ¾" EMT or ½" rigid conduit.

Figure 3:
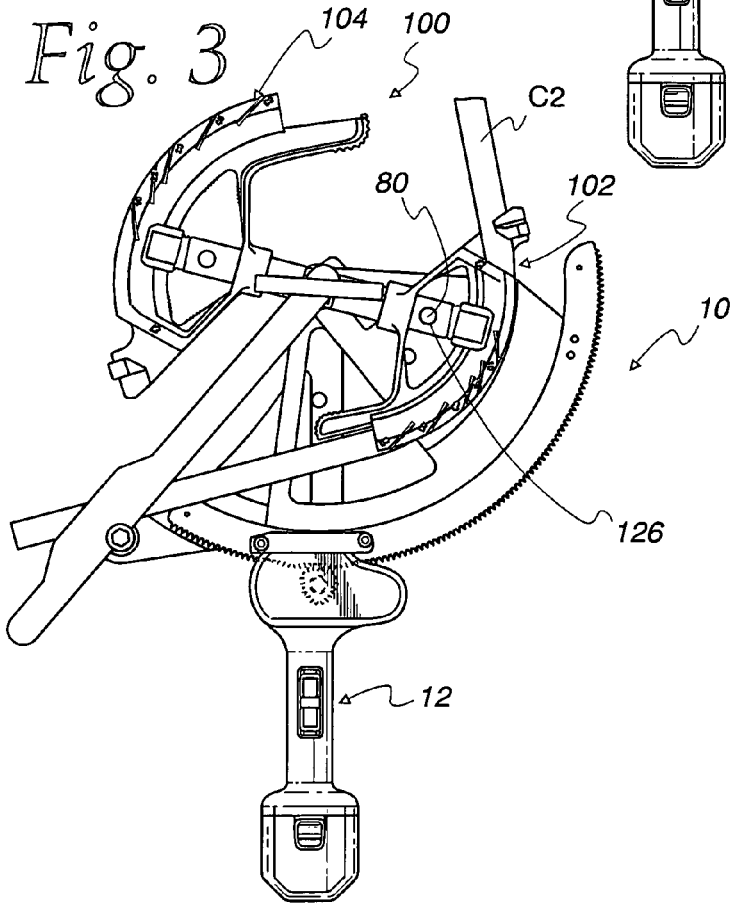
FIG. 3 is a front elevation view, similar to FIG. 1, showing the powered conduit bender configured to bend conduit of a second size.

If the dual bender shoe 100 is to be used with ½" EMT conduit, then the first shoe 100 is removed, reversing the procedure discussed above. The shoe 100 is then rotated 180° so that the first bender 102 is in the operative position for bending ½" EMT conduit C2, as shown in FIG. 3. In this configuration, the guide pin 80 is received in the first opening 126, as is shown.

Referring to FIG. 6, the second shoe 200 is illustrated. The second shoe 200 includes the third bender 202 of a size to bend 1" EMT or ¾" rigid conduit. A pipe 204 includes a threaded end 206 and a distal end 208 connected to a carrying handle 210. A first opening 212 is positioned at approximately a midpoint of the pipe 204 and includes a surrounding hub 214. A second opening 216 is provided between the first opening 212 and the threaded end 206. As above, spacing between the openings 212 and 216 is identical to spacing between the T-bar shaft 76 and the guide pin 80. The pipe 204 passes through a collar 218 on the third bender 202 with the threaded end 206 threaded into an adapter 220. The second shoe 200 can be used by removing the first shoe 100 from the platform 56 and positioning the shoe 200 with the second opening 216 receiving the guide pin 80 and the T-bar shaft 76 inserted through the first opening 212 and threaded into the pivot connection 30.

Figure 7:
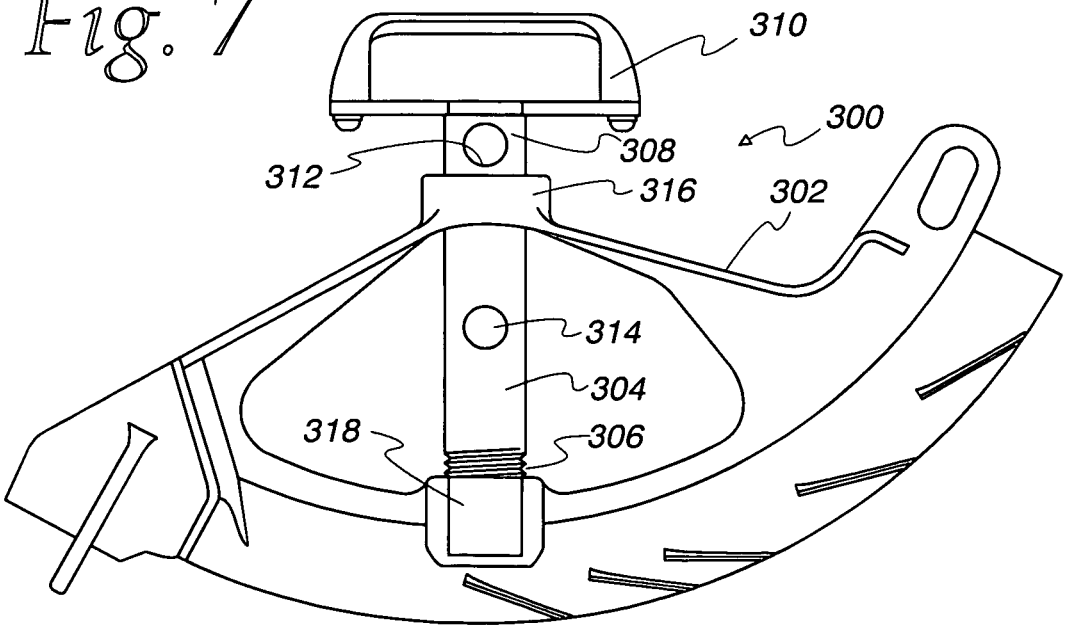
FIG. 7 is a front elevation view of a single bender shoe for a fourth size conduit.

Referring to FIG. 7, the third shoe 300 includes the fourth bender 302 adapted for use with 1¼" EMT and 1" rigid conduit. A pipe 304 includes a threaded end 306 and an opposite end 308 connected to a carrying handle 310. A first opening 312 is provided proximate the distal end 308. A second opening 314 is provided midway between the first opening 312 and the threaded end 306. The pipe 304 passes through a collar 316 on the fourth bender 302 with the threaded end 306 threaded into an adapter 318. Spacing between the openings 312 and 314 is equal to spacing between the T-bar shaft 76 and the guide pin 80, as discussed above. As is apparent, relative positions of the openings 312 and 314 is positioned so that the bender is in an appropriate radial position relative to the pivot connection 30 to properly bend a 1¼" EMT or 1" rigid conduit.

The use of the powered conduit bending tool 10 is generally consistent with that described in the co-pending application incorporated by reference herein. The operation is described herein with respect to the use of the second bender 104, as shown in FIGS. 1 and 2 in the operative position. The platform 56 and thus the second bender 104 are initially pivoted away from the drive gear 18 so that it does not engage the arcuate rack 66 and the second bender 104 is freely rotatable. The conduit C1, which is initially straight, is positioned in the second bender 104 in a conventional manner with the hook 110 engaging the conduit C1. With the conduit C1 seated in the hook 110, the platform 56 can be released and it pivots about the pivot connection 30 until the conduit C1 engages the guide 36. Particularly, the conduit C1 would be seated in the spool concave guide surface 39, which has a curved cross section. As is apparent, with a different size bender, and different size conduit, the relative position of the conduit relative to the platform 56 can vary. The self-centering of the guide 36, provided by the spring 44, causes the axial position of the guide spool 38 to be self-adjusted on the shaft 40 to self-center the guide 36 according to the position of the conduit C1 to be bent.

Incident to the conduit C1 engaging the guide 36, the arcuate rack 66 engages the drive gear 18. The user can then actuate the switch 20 in a forward direction to begin rotating the platform 56 and thus second bender 104 in a counter clockwise direction, relative to the orientation illustrated in FIG. 2. The hook 110 maintains the conduit C1 in the second bender 104. The guide 36 acts as a support surface which supports and guides the conduit C1. The bending force exerted on the second bender 104 by the powered drive is transmitted to the conduit C1 by the hook 110 which bends the conduit C1 around the second bender 104 in a conventional manner, albeit using a battery-operated tool rather than manual bending. FIG. 2 illustrates the conduit C1 bent with the arcuate rack 66 in a near fully extended position to provide approximately a 90° bend. To release the conduit C1, the switch 20 is moved to the reverse position to return the rotary platform 56 to a neutral position so that the conduit C1 can be simply removed.

Operation of the tool 10 using the other shoes is similar to that discussed relative to the second bender 104.

Although the powered conduit bending tool 10 is described in connection with bending conduit, the device can be more generally thought of as a powered tube bender for bending any thin walled tube intended to be formed in this manner. Thus, use of the term conduit herein is intended to refer to any such tubing element, as will be apparent.

In operating the powered conduit bender 10, the housing 12 can be held up so that it is easily visible to the user to determine if the proper angle has been satisfied. As such, the benders 102, 104, 202 and 302 may include conventional markers or other indicators indicating the angle. Moreover, the gearing relationship provided between the drive gear 18 and the driven arcuate rack 66 is such that the drive can be started and stopped as necessary to provide the desired bend.

Thus, in accordance with their invention, there is provided a portable, powered conduit bender of the size of a conventional portable power tool enabling conduits of different sizes to be bent with a one handed operation.

The invention claimed is:

1. A powered conduit bending tool comprising:

a portable drive housing including a handle and having a powered drive gear;

a bracket secured to the housing defining a pivot connection spaced from the drive gear;

a guide operatively secured to the housing;

a platform pivotally connected to the bracket at the pivot connection and including a driven gear operatively engaging the drive gear to controllably pivot the platform; and a shoe removably mountable to the platform and comprising a first bender defining a downwardly opening arcuate channel selectively positionable proximate the guide, a hook proximate one end of the first bender for engaging a conduit received in the channel, wherein, in use, the guide supports a conduit engaged by the hook and pivotal movement of the shoe driven by the platform deforms the conduit as it passes by the guide.

2. The powered conduit bender of claim 1 wherein the driven gear comprises gear teeth disposed in a path adjacent the arcuate channel.

3. The powered conduit bender of claim 1 wherein the driven gear comprises an arcuate rack secured to the platform.

4. The powered conduit bender of claim 1 wherein the platform comprises a pivot opening receiving a bolt connected to the bracket at the pivot connection and a guide pin spaced from the pivot opening a select distance.

5. The powered conduit bender of claim 4 wherein the shoe comprises a pipe threadably connected to the first bender and the pipe includes a pair of spaced openings spaced apart the select amount, wherein one of the openings receives the bolt and the other opening receives the guide pin.

6. The powered conduit bender of claim 4 wherein the shoe comprises a pipe threadably connected at one end to the first bender and at a second end to a second bender of a different size from the first bender, and the pipe includes a center opening, a first opening associated with the first bender and spaced from the center opening by the select amount, and a second opening associated with the second bender and spaced from the center opening by the select amount, wherein the center opening receives the bolt and one of the first and second openings receives the guide pin dependent on which of the first and second benders is to be used.

7. The powered conduit bender of claim 5 wherein the shoe comprises a handle at a distal end of the pipe.

8. The powered conduit bender of claim 1 wherein the guide comprises a spool.

9. The powered conduit bender of claim 8 wherein the spool comprises a self centering spool.

10. The powered conduit bender of claim 8 wherein the spool is mounted to a shaft on the bracket and a seat spring self centers the spool.

11. The powered conduit bender of claim 1 wherein a battery is removably connected to the handle to provide a battery operated tool.

12. The portable powered conduit bender of claim 9 wherein the guide spool comprises a roller.

13. A powered conduit bending tool comprising:

a portable drive housing including a handle and having a powered drive gear;

a bracket secured to the housing defining a pivot connection spaced from the drive gear, the bracket including a shaft supporting a self centering guide spool;

a platform pivotally connected to the bracket at the pivot connection and including a driven gear operatively engaging the drive gear to controllably pivot the platform; and a shoe mounted to the platform and comprising a bender defining a downwardly opening arcuate channel selectively positionable proximate the guide, a hook proximate one end of the bender for engaging a conduit received in the channel, wherein, in use, the guide spool is self centered on the shaft to support conduit that is engaged by the hook and pivotal movement of the shoe driven by the platform deforms the conduit as it passes by the guide spool.

14. The portable powered conduit bender of claim 13 wherein the driven gear comprises gear teeth disposed in a path adjacent the shoe.

15. The portable powered conduit bender of claim 13 wherein the driven gear comprise an arcuate rack.

16. The portable powered conduit bender of claim 13 further comprising a seat spring on the shaft between the bracket and the guide spool.

17. The powered conduit bender of claim 13 wherein a battery is removably connected to the handle to provide a battery operated tool.

18. The powered conduit bender of claim 13 wherein the platform comprises a pivot opening receiving a bolt connected to the bracket at the pivot connection and a guide pin spaced from the pivot opening a select distance.

19. The powered conduit bender of claim 18 wherein the shoe comprises a pipe threadably connected to the bender and the pipe includes a pair of openings spaced apart the select amount, wherein one of the openings receives the bolt and the other opening receives the guide pin.

* * * * *